US007568471B2

(12) United States Patent
Harper et al.

(10) Patent No.: US 7,568,471 B2
(45) Date of Patent: Aug. 4, 2009

(54) DIESEL FUEL INJECTION PRIMING SYSTEM

(75) Inventors: Henry W Harper, Milford, MI (US); Peter Hubl, Clarkston, MI (US); Bryan A Kuieck, Lowell, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 12/204,199

(22) Filed: Sep. 4, 2008

(65) Prior Publication Data

US 2009/0084361 A1 Apr. 2, 2009

Related U.S. Application Data

(60) Provisional application No. 60/975,991, filed on Sep. 28, 2007.

(51) Int. Cl.
*F02M 37/00* (2006.01)

(52) U.S. Cl. ..... 123/514; 123/179.17

(58) Field of Classification Search ..... 123/510, 123/511, 514, 456, 457, 458, 179.16, 179.17
See application file for complete search history.

(56) References Cited

U.S. PATENT DOCUMENTS 4,274,380 A * 6/1981 de Vulpillieres ..... 123/456
4,440,138 A * 4/1984 Smith ..... 123/557
5,207,203 A * 5/1993 Wagner et al. ..... 123/514
5,285,759 A * 2/1994 Terada et al. ..... 123/514
5,425,342 A * 6/1995 Ariga et al. ..... 123/456
5,551,404 A * 9/1996 Bauerle et al. ..... 123/514
5,749,345 A * 5/1998 Treml ..... 123/456
5,765,537 A * 6/1998 Coleman et al. ..... 123/514
5,918,578 A * 7/1999 Oda ..... 123/456
6,024,064 A * 2/2000 Kato et al. ..... 123/179.17
6,142,127 A * 11/2000 Maass ..... 123/514
6,234,151 B1 * 5/2001 Eck ..... 123/514
6,805,106 B2 * 10/2004 Kumagai et al. ..... 123/514
6,981,491 B2 * 1/2006 Schmitt et al. ..... 123/514
7,219,654 B2 * 5/2007 Ludwig et al. ..... 123/446
7,278,404 B2 * 10/2007 Wolters et al. ..... 123/514

* cited by examiner

*Primary Examiner*—Thomas N Moulis
(74) *Attorney, Agent, or Firm*—Harness, Dickey & Pierce, P.L.C.

(57) ABSTRACT

A fuel injection priming system includes a fuel supply line connected to a fuel supply rail. A plurality of piezoelectric fuel injectors are connected to the fuel supply rail. An injector return fuel line is connected to the fuel injectors and in communication with a fuel supply line via a diverter valve to allow pressure fuel from the high pressure fuel pump return line to pressurize the injector return fuel line to backfill the injectors during a priming operation. A fuel restriction device is in communication with the diverter valve to restrict fuel flow through the injector return line to provide sufficient backfill for the fuel injectors during the priming operation and to allow fuel to pass to the fuel tank from the injector return fuel line during normal operation.

4 Claims, 1 Drawing Sheet

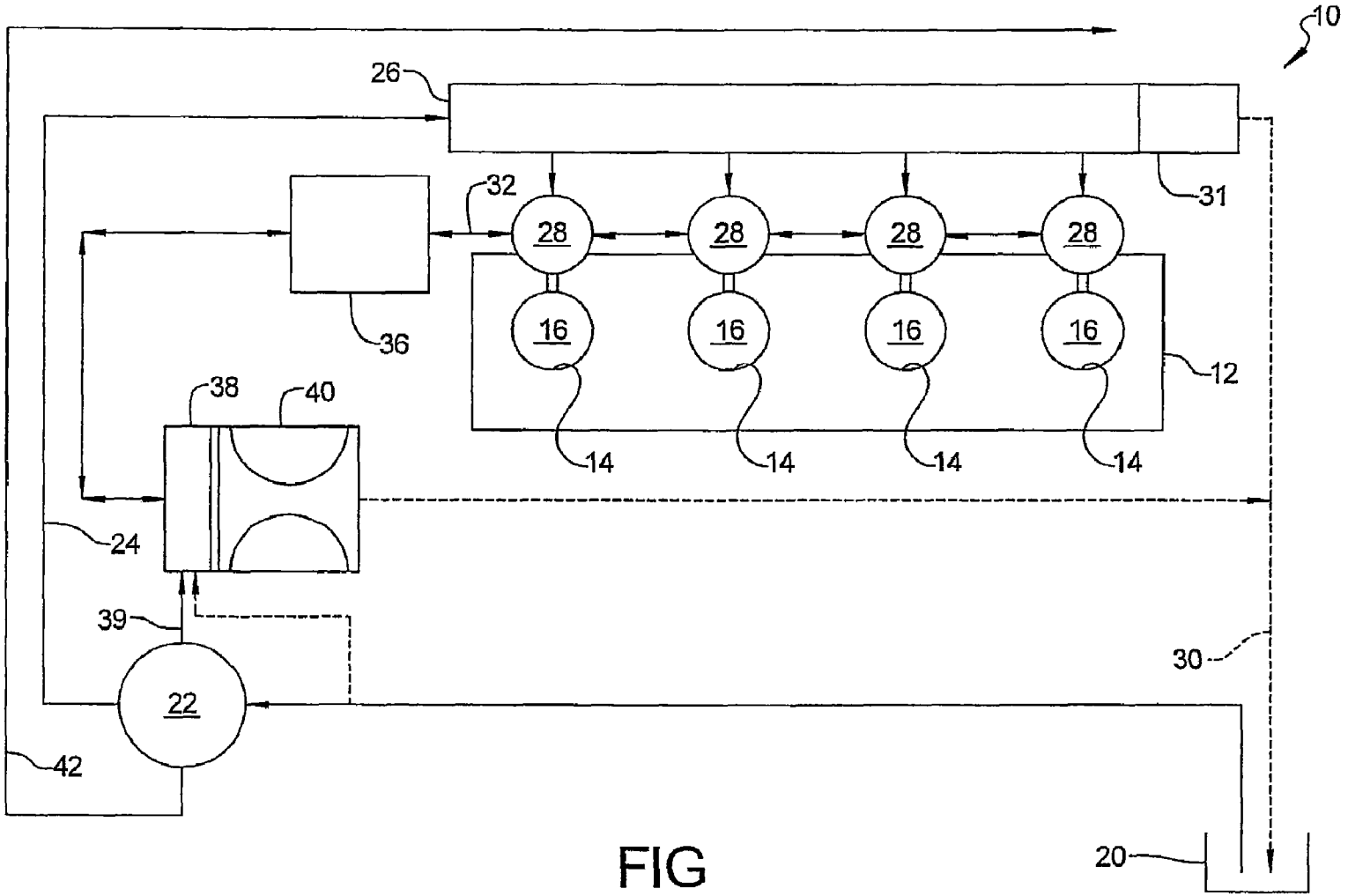
FIG

DIESEL FUEL INJECTION PRIMING SYSTEM

CROSS-REFERENCE TO RELATED APPLICATIONS

This application claims the benefit of U.S. Provisional Application No. 60/975,991, filed on Sep. 28, 2007. The disclosure of the above application is incorporated herein by reference.

FIELD

The present disclosure relates to fuel injection systems and more particularly, to a diesel fuel injection priming system.

BACKGROUND

The statements in this section merely provide background information related to the present disclosure and may not constitute prior art.

Diesel engines commonly employ a piezoelectric fuel injection system for injecting fuel into the engine. When the diesel engine piezoelectric fuel injection system is run out of fuel, vapor can be trapped in the fuel injectors. This vapor can inhibit operation of the injectors that can prevent the engine from re-starting after normal priming of the fuel system with fuel.

SUMMARY

A fuel injection priming system includes a fuel supply line connected to a fuel supply rail. A plurality of piezoelectric fuel injectors are connected to the fuel supply rail. An injector return fuel line is connected to the fuel injectors and in communication with a pressurized fuel line via a diverter valve and return fuel restriction device to allow fuel from the pressurized fuel line to pressurize the injector return fuel line and backfill the injectors during a priming operation.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

The FIGURE shows a schematic view of a diesel engine system having a fuel injection priming system according to the present disclosure.

DETAILED DESCRIPTION

The following description is merely exemplary in nature and is not intended to limit the present disclosure, application, or uses.

With reference to the attached FIGURE, the diesel engine system 10 having a fuel injection priming system, according to the principles of the present disclosure, will now be described. The engine system 10 includes an engine 12 having an engine block defining a plurality of cylinders 14 and a plurality of pistons 16 disposed in respective ones of said plurality of cylinders 14.

A fuel supply system is provided for supplying fuel to each of the cylinders 14 of the engine 12. The fuel supply system includes a fuel tank 20 in communication with a fuel pump 22 that supplies fuel through a fuel supply line 24 to a fuel rail 26. The fuel rail 26 is connected to a plurality of fuel injectors 28 each corresponding with a respective one of the plurality of cylinders 14. A return fuel line 30 is in communication with the fuel supply rail 26 and with fuel tank 20. A controllable pressure relief valve 31 can be provided in the return fuel line 30 to direct fuel from the fuel rail 26 back to the fuel tank 20 via the return fuel line 30. An injector return fuel line 32 is connected to the injectors 28 and is in communication with fuel tank 20 via a pressure regulating valve 36, a diverter valve 38 and a return fuel restriction device 40. The pressure regulating valve 36 is provided in communication with the injector return fuel line 32 and regulates/maintains the pressure of fuel supplied to the injectors 28. The diverter valve 38 can be an electrical or mechanical valve that can be controlled to provide pressurized fuel to the injectors 28 from the high pressure fuel pump return line 39 during a priming operation.

The return fuel restriction device 40 is provided in communication with the diverter valve 38 to restrict flow to the fuel tank 20 sufficiently to allow fuel from the high pressure fuel pump return line 39 to backfill the injectors 28, thus eliminating the vapor that can become trapped after fuel run out.

The fuel injectors 28 can be piezoelectric fuel injectors. When the diesel engine piezoelectric fuel injection system has run out of fuel, vapor can become trapped in the fuel injectors 28. This vapor prevents the engine 12 from re-starting after normal priming of the fuel system with fuel. The injectors 28 may not work properly when filled with an unpressurized vapor/fuel mixture. By pressurizing the injector return fuel line 32 via the diverter valve 38 with restricted by-pass 40, adequate priming of the piezoelectric injectors is provided to enable engine re-start. The priming system provides adequate return fuel pressure to allow the piezoelectric injectors to function as needed for engine re-start by allowing the pressure supplied via the diverter valve 38 with restricted by-pass 40 to provide sufficient pressure to backfill the injector return fuel lines 32, to enable engine re-start.

What is claimed is:

1. A fuel injection priming system for an engine, comprising:

a fuel tank;

a fuel supply line connected to the fuel tank;

a plurality of fuel injectors connected to the fuel supply line;

an injector return fuel line connected to the plurality of fuel injectors and in communication with a high pressure fuel pump return line via a diverter valve selectively controllable to allow fuel from a fuel supply line to pressurize the injector return fuel line during a priming operation; and a fuel restriction device in communication with the diverter valve to pressurize the injector return fuel line sufficient to backfill the plurality of fuel injectors and to allow fuel to pass to the fuel tank during normal operation.

2. The fuel injection priming system according to claim 1, wherein the fuel supply line includes a fuel pump.

3. An engine system, comprising:

an engine block defining a plurality of cylinders;

a plurality of pistons disposed in respective ones of the plurality of cylinders;

a fuel tank;

a fuel supply line connected to the fuel tank;

a fuel rail connected to the fuel supply line;

a plurality of fuel injectors connected to the fuel rail and in communication with a respective one of the plurality of cylinders;

an injector return fuel line connected to the fuel rail and in communication with the fuel supply line via a diverter valve selectively controllable to allow fuel from the high pressure fuel pump return line to pressurize the injector return fuel line during a priming operation; and a fuel restriction device in communication with the diverter valve to pressurize the injector return fuel line sufficient to backfill the plurality of fuel injectors and to allow fuel to pass to the fuel tank during normal operation.

4. The engine system according to claim 3, wherein the fuel supply lines include a fuel pump.

* * * * *